US005403222A

United States Patent [19]

Koenig et al.

[11] Patent Number: 5,403,222

[45] Date of Patent: Apr. 4, 1995

[54] SELF-PROPELLED AMUSEMENT OBJECT

[76] Inventors: Theodore L. Koenig, 2053 Dayton, Chicago, Ill. 60614; Rainer Wiebalck, 3929 Kansas St., #9, San Diego, Calif. 92104

[21] Appl. No.: 46,591

[22] Filed: Apr. 12, 1993

[51] Int. Cl.[6] ..... A63H 3/06; A63H 27/127

[52] U.S. Cl. ..... 446/220; 446/37; 446/175; 446/225

[58] Field of Search ..... 446/36–37, 446/154, 157–158, 175, 178–179, 187, 191, 220–221, 225; 244/30, 31, 96, 97

[56] References Cited

U.S. PATENT DOCUMENTS

| | | | |
|---|---|---|---|
| 12,250 | 7/1904 | Berry | 244/30 |
| 3,746,282 | 7/1973 | Vorachek | 244/31 |
| 3,822,503 | 7/1974 | Morris . | |
| 3,903,639 | 9/1975 | Howell . | |
| 4,041,886 | 8/1977 | Knipp . | |
| 4,086,724 | 5/1978 | McCaslin | 446/175 |
| 4,262,864 | 4/1981 | Eshoo | 244/31 |
| 4,536,985 | 8/1985 | Caviness | 446/158 |
| 4,547,167 | 10/1985 | Bergmann | 446/220 |
| 4,729,750 | 3/1988 | Prusman | 446/225 |
| 4,799,914 | 1/1989 | Hutchinson | 446/220 |
| 4,934,631 | 1/1990 | Birbas | 244/30 |

*Primary Examiner*—Robert A. Hafer
*Assistant Examiner*—Jeffrey D. Carlson
*Attorney, Agent, or Firm*—Wood, Phillips, VanSanten, Hoffman & Ertel

[57] ABSTRACT

An object that is selectively movable through a fluid in which the object is at least partially immersed and which is adapted to automatically change between different operating states without operator intervention. A movable object has a vessel / balloon with first means having first and second states for causing the vessel to move within the fluid. The first means in the first state thereof cause the vessel to move along a first travel path. The first means in the second state thereof cause the vessel to one of a) move along a second travel path within the fluid which is different from the first travel path and b) remain substantially in a static state within the fluid. Second means are provided on the vessel for automatically changing the first means from one of its first and second states to the other of its first and second states and back to its original state without intervention by an operator.

21 Claims, 7 Drawing Sheets

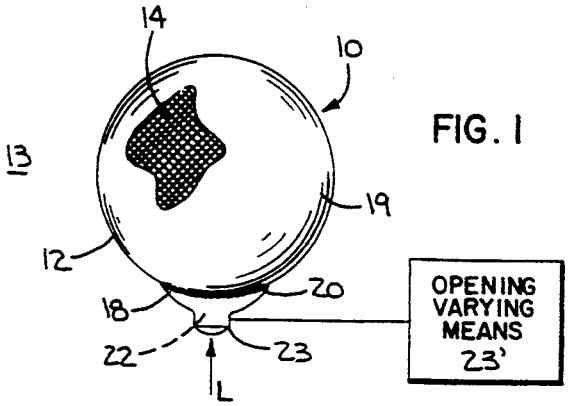
FIG. 1
FIG. 2
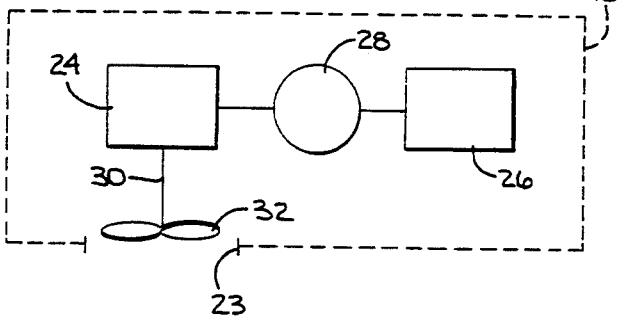
FIG. 3
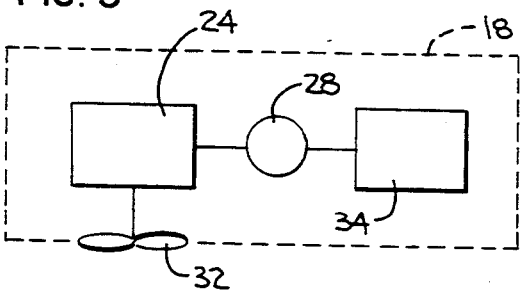
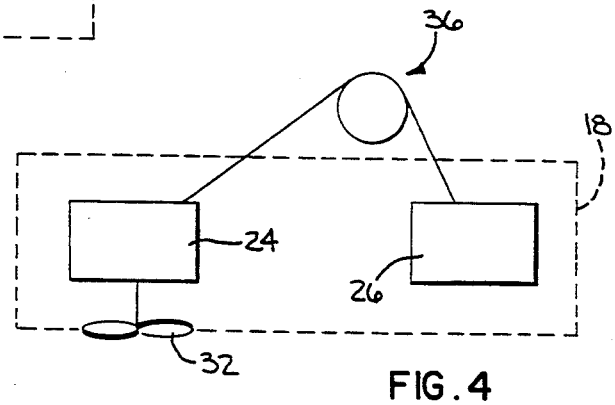
FIG. 4
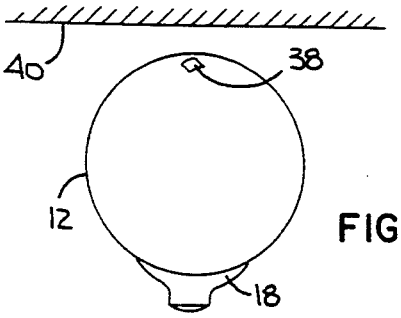
FIG. 5

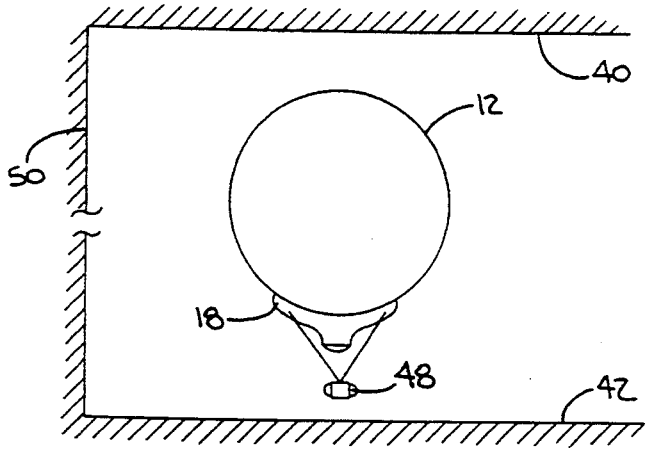
FIG. 10
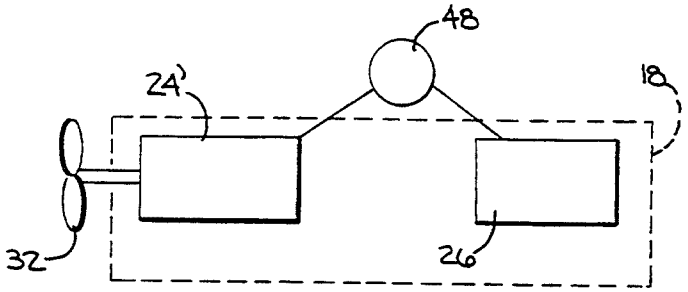
FIG. 11
FIG. 13
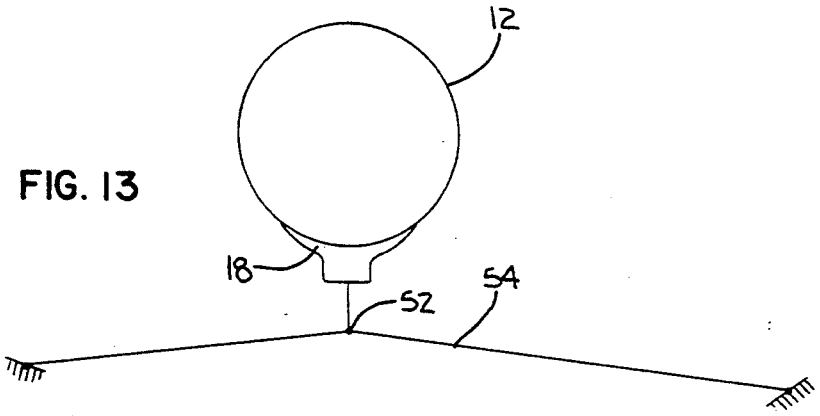

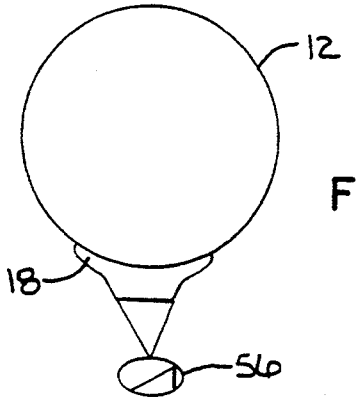
FIG. 14
FIG. 15
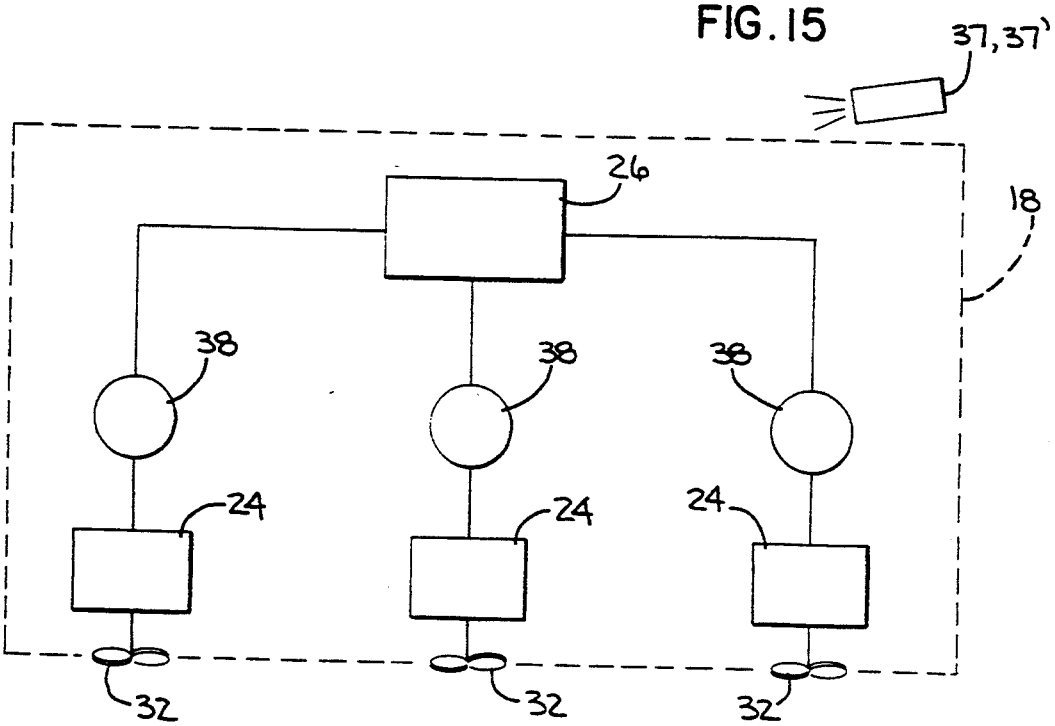
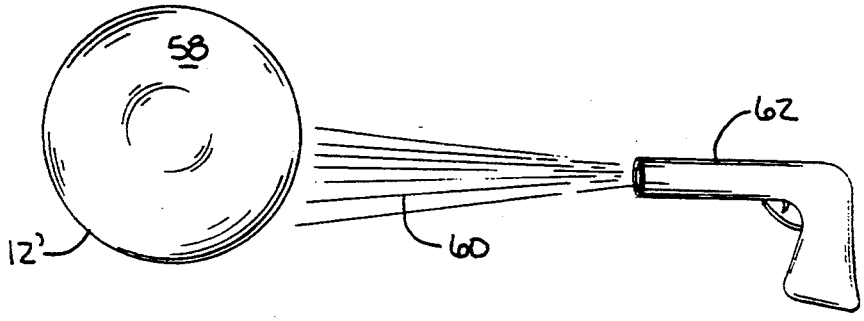
FIG. 16

SELF-PROPELLED AMUSEMENT OBJECT

BACKGROUND OF THE INVENTION

1. Technical Field

This invention is a self-propelled movable object and, more particularly, this invention is a buoyant self-propelled object which, in one form, is capable of automatically changing operating states without operator intervention.

2. Background Art

Balloons are available in a wide range of sizes and are used for a variety of commercial and domestic purposes. A balloon typically has a substantially nonporous and generally spherical skin which is inflated with a gas. The size of the balloon and the type of gas with which the skin is inflated are dictated by the application for which the balloon is intended.

For instance, conventional party balloons which are used to decorate a room are small enough that when inflated they can be easily handled by an individual and are well suited for indoor use. Decorative balloons generally are brightly colored and can be manually inflated with the breath of an operator. Such balloons when inflated typically are rested on a horizontal surface or are attached to a wall, ceiling, or other suitable location.

In applications where it is desirable for a balloon to be buoyant so that the balloon will rise and float in the atmosphere, the balloon is filled with a gas which is lighter than air, such as helium. Buoyant balloons are used, for example, for children's amusement. Buoyant balloons also are used for advertising purposes, wherein the balloon exterior bears a promotional message or logo. Lighter-than-air balloons, when used indoors, typically assume an equilibrium position at an elevation at which the balloon remains substantially stationary. Alternatively, light-than-air balloons can be secured as by an inextensible cord to maintain a desired position.

Members of the balloon industry have attempted to stimulate interest in balloons by developing new forms of balloons, such as balloons which have bright metallized mylar skins and buoyant balloons which simulate animated objects to include, for example, segmented "arms" and "legs". Manufacturers also have promoted the use of balloons as a type of occasional greeting device.

Despite the efforts of balloon manufacturers to sustain enthusiasm for balloon products, the balloon market has become saturated with similar goods. Balloon manufacturers continue to search for innovative enhancements capable of generating renewed appeal for balloons.

SUMMARY OF THE INVENTION

The present invention comprehends a new and improved movable object which is adapted to automatically change between different operating states.

An exemplary embodiment of the invention achieves the foregoing advantage in an object that is selectively movable through a fluid in which the object is at least partially immersed. The object includes a vessel with first structure having first and second states for causing the vessel to move within the fluid. The first structure in the first state thereof causes the vessel to move along a first travel path. The first structure in the second state thereof causes the vessel to one of a) move along a second travel path within the fluid which is different from the first travel path and b) remain substantially in a static state within the fluid. Second structure is provided on the vessel for automatically changing the first structure from one of its first and second states to the other of its first and second states without intervention by an operator.

More particularly, the movable object is a balloon which contains a predetermined quantity of fluid. A motorized propeller is mounted on the balloon and generates a force which causes the balloon to move. In one operating state of the propeller, the balloon is caused to move along a first travel path. In another operating state of the propeller, the balloon is caused to one of a) move along a second travel path which is different from the first travel path and b) remain substantially in a static state. A programmable timer automatically changes the propeller from one of its operating states to another of its states without intervention by an operator.

In one form of the invention, the balloon contains a gas which is lighter than air. In a preferred embodiment, the balloon contains helium.

An exemplary embodiment of the invention has a battery carried by the balloon for supplying power to an electrical motor which, in turn, rotates a propeller. The propeller assembly preferably has a variable opening through which the propeller directs air. The size of the opening can be manually changed to vary the magnitude of a force generated by the propeller. In a modified form the propeller assembly has a solar energy cell for powering the motor. In a second modified form, the propeller is powered by a rubber band and the motor and the battery are omitted.

In one form, the propeller has a first position in which the propeller generates a force for moving the object in a first direction and a second position in which the propeller generates a force for moving the object in a second direction. Preferably, a link is pivotably connected between the vessel and the propeller and permits the propeller to automatically move between the first position and the second position thereof in response to the thrust force.

In another aspect of the invention the movable object has a switch for automatically changing the propeller assembly from one of its operating states to another of its operating states without intervention by an operator. For instance, the propeller assembly changes from one of its operating states to another of its operating states by reversing the direction of the motor and the propeller.

In one form of the invention, the switch is a light sensitive switch which is actuated when the switch either is exposed to or is concealed from light. In another form, the switch is a force sensitive switch which is actuated when the balloon comes within a predetermined distance of an obstruction. In yet another form, the switch is a motion sensitive switch which is activated when movement of the balloon is obstructed. In a modified form, the switch is an attitude sensitive switch which is actuated when the balloon tilts.

The propeller assembly, in one operating state thereof, is adapted to cause the balloon to move in a direction which is substantially opposite to the direction in which the balloon is caused to move when the propeller assembly is in another operating state. In a preferred embodiment, the propeller is powered by a reversible motor. In one illustrated embodiment, the propeller causes the balloon to move in a substantially vertical path, and in a modified form, the propeller causes the balloon to move in a substantially horizontal path.

In another form of the invention, the balloon is guided on a tether to constrain movement of the balloon along a predetermined path when the propeller is in at least one of its operating states.

The invention contemplates that the motorized propeller and on the liner is carried in a basket suspended from the balloon by a line. The basket is suspended by either a single line, when it desired that the basket rotates relative to the balloon when the propeller operates, or a pair of lines when it is desired to prevent the basket from rotating relative to the balloon. The basket can be suspended in a variety of orientations whereby the propeller generates a thrust force causing the balloon to move in vertical or horizontal directions. A ballast receiving member is attached to the line and receives ballast therein for modifying buoyancy characteristics of the balloon.

The invention further comprehends the provision of an object that is movable through the atmosphere in response to selective impingement of light on the object. The object is a balloon which contains a predetermined quantity of a fluid. A propeller assembly on the balloon generates a force which causes the balloon to move. A light sensitive cell on the balloon is responsive to the impingement of light thereon for selectively changing the propeller assembly between a first operating state and a second operating state. In the first operating state, the propeller assembly causes the balloon to move along a first travel path. In the second operating state, the propeller assembly causes the balloon to one of a) move along a second travel path within a fluid which is different from the first travel path and b) remain substantially in a static state within a fluid.

Alternatively, the object has a sound sensor on the balloon responsive to the impingement of an audio signal thereon for selectively changing the propeller assembly between the first operating state and the second operating state.

In another form, the movable object has a plurality of rotatable propellers each having a corresponding motor for rotating the same. Each of the motors has an associated light sensitive cell which when selectively impinged by a beam of light activates the associated motor and rotates the corresponding propeller.

In another form of the invention, the balloon has light absorption means for absorbing light so that the temperature of fluid within the balloon increases when light impinges on the balloon. Preferably, the balloon has a non-reflective black exterior surface.

In yet another form, the object is movable through the atmosphere in response to the selective impingement of liquid on the object. A receptacle is attached to a lighter-than-air balloon for receiving liquid impinged on the balloon exterior. The balloon descends when the weight of liquid in the receptacle exceeds the lift force of gas in the balloon. Liquid spills from the receptacle when the receptacle strikes the ground and the balloon again rises. The receptacle has an opening through which liquid received in the receptacle escapes, thereby requiring that the receptacle be filled at a rate greater than the rate at which liquid escapes through the opening in order to cause the balloon to descend.

The movable object of the present invention is extremely simple to manufacture and is economical of construction, while yet providing unique and versatile operation in a variety of novel applications.

DESCRIPTION OF THE DRAWINGS

FIG. 1 is a side elevation view of a movable object according to the invention;

FIG. 2 is a schematic illustration of a means for propelling the movable object;

FIG. 3 is a schematic illustration of one alternative means for propelling the movable object including a solar cell;

FIG. 4 is a schematic illustration of a second alternative means for propelling the movable object;

FIG. 5 is a side elevation view of an embodiment wherein the second alternative means has a light sensitive switch on the top of the movable object;

FIG. 10 is a side elevation view of an embodiment wherein the second alternative means has a motion sensitive switch suspended from the movable object;

FIG. 11 is a schematic illustration of the embodiment shown in FIG. 10;

FIG. 13 is a side elevation view of a tethered movable object according to the invention;

FIG. 14 is a side elevation view of an embodiment wherein the second alternative means has an attitude sensitive switch suspended from the movable object;

FIG. 15 is a schematic illustration similar to FIG. 4 but having multiple photocells;

FIG. 16 is a perspective view of an alternative embodiment of a movable object wherein a light gun impinges light on the object;

DETAILED DESCRIPTION OF THE INVENTION

Figure 6:
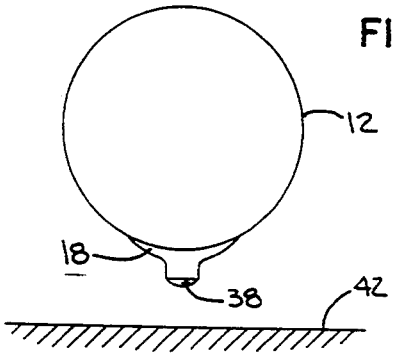
FIG. 6 is a side elevation view of an embodiment wherein the second alternative means has a light sensitive switch on the bottom of the movable object.

A movable object according to the invention is generally designated 10 in FIG. 1 and includes a vessel in the form of a balloon 12. The balloon 12 is immersed in the atmosphere 13 and contains a predetermined quantity of a fluid 14. A shell 18 is attached to the balloon 12 and houses means adapted to selectively move the balloon 12 through the atmosphere 13. Moreover, it is a feature of this form of the present invention that the shell 18 houses means suitable for automatically changing operating states of the movable object 10 without requiring operator intervention.

In this regard the balloon 12 has a substantially nonporous outer skin 19 which may be either a flexible or an inflexible material. The fluid 14 contained in the balloon 12 preferably is helium, although the invention comprehends balloons containing a variety of gases, including other gases which preferably, although not necessarily are lighter than air.

The shell 18 preferably is made of vacuum formed plastic whereby the shell 18 has a relatively low weight which contributes favorably to the buoyancy characteristics of the movable object 10. Any suitable means for attaching the shell 18 to the balloon 12 may be employed. In the embodiment illustrated in FIG. 1, the shell is bonded to the skin 19 of the balloon with an adhesive 20. The shell 18 defines an interior chamber 22 for housing the means to move the balloon. An opening 23 in the shell 18 connects the interior chamber 22 with the atmosphere 13. A means 23' is provided to vary the size of the opening 23.

Referring to FIG. 2, the shell 18, which is shown schematically, houses an electric motor 24, a battery 26 and a programmable timer 28. An output shaft 30 on the motor 24 mounts a rotatable propeller 32 in substantial alignment with the variable opening 23 in the shell 18. Selective operation of the electric motor 24 by the timer 28 causes the output shaft 30 and the propeller 32 to rotate and displace a volume of air through the opening 23. In what is believed to be a generally understood manner to those skilled in the art, air flow through the opening 23 generates a force, indicated "L" in FIG. 1, which propels the balloon 12 in a direction aligned with the direction of the force "L". The magnitude of the propulsive force developed by the propeller 32 for a given propeller speed changes with the size of the variable opening by reducing the size of the opening 23.

The timer 28 is connected between the battery 26 and the motor 24 and causes the motor 24 to operate for predetermined lengths of time. For instance, the timer 28 can be preprogrammed such that energy from the battery 26 initially is disconnected from the motor 24 and the balloon 12 assumes an equilibrium position wherein the balloon 12 is in a substantially static state. When the timer 28 activates, operation of the motor 24 commences and the propulsion force created by the propeller 32 disturbs the equilibrium position of the balloon 12. Alternatively, the timer 28 can randomly actuate the motor 24 to achieve a variable and unpredictable disturbance of the balloon 12.

The balloon 12 moves along a travel path determined by the direction of the propulsion force "L" until the operating state of the motor 24 is changed. More specifically, the timer 28 controls the motor 24 to operate for a predetermined time period. At the end of the operating period, the timer 28 disconnects the supply energy from the battery 26 and the motor 24 assumes a deactivated state wherein rotation of the propeller 32 ceases. In the absence of an external propulsion force, the balloon 12 no longer moves along the first travel path and falls toward the ground under the effect of gravity. The motor 24 thus is adapted to cause the balloon 12 to move in a substantially vertical direction. In an exemplary embodiment of the invention, the timer 28 controls the motor 24 to rotate the propeller 32 intermittently for periods of approximately five to ten seconds.

It will be appreciated that the foregoing structure provides a novel and entertaining performance with an otherwise stationary balloon. That is, after remaining at rest in a substantially static state for a predetermined time period, the balloon 12 is self-propelled upwardly without operator intervention (that is, while the balloon 12 remains unattended) when the timer 28 activates the motor 24. The timer 28 advantageously can be programmed to prescribe a desired schedule of operation whereby the balloon 12 intermittently is propelled. Unattended operation of the balloon 12 and automatic changing of the balloon's operating state enhances the visual effect produced and creates a startling and exciting impression on individuals who view the balloon.

One modified form of the invention is schematically illustrated in FIG. 3 wherein it is shown that a timer 28 alternatively supplies the motor 24 with energy from a generally conventional solar cell 34. The structure shown in FIG. 3 provides the advantages described above relative to FIGS. 1 and 2 and obviates the need to periodically replace or recharge the battery 26.

An alternative embodiment of the invention is shown in FIG. 4 wherein automatic switch means, generally designated 36, is interconnected between the battery 26 and the motor 24 for selectively rotating the propeller 32. Specific embodiments of the switch means 36 are illustrated in FIGS. 5–11.

FIG. 5 shows a light sensitive cellular switch 38 (that is, a photocell) mounted on the upper side of the balloon 12. The motor 24 rotates the propeller 32 and generates a force for lifting the balloon 12. When the top of the balloon 12 contacts an overhead obstruction, such as the ceiling 40 of a room in which the balloon 12 is operated, light is concealed from the switch 38 and the motor 24 is deactivated. The balloon 12 then begins to fall under the effect of gravity until the cellular switch 38 receives sufficient light to activate the motor 24 and generate a force for lifting the balloon. The cycle of activating and deactivating the motor 24 continues and the balloon 12 periodically engages the ceiling 40.

Figure 7:
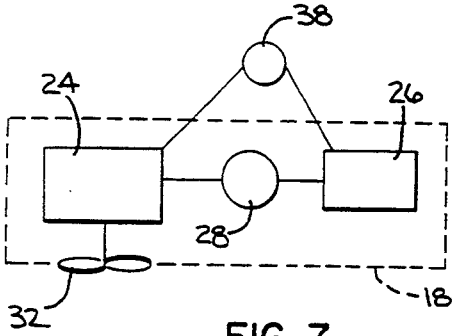
FIG. 7 is a schematic illustration of the embodiment shown in FIG. 6.

FIG. 6 illustrates an embodiment of the invention wherein a light sensitive cell 38 is mounted on the underside of the balloon 12. FIG. 7 schematically illustrates the embodiment shown in FIG. 6. The motor 24 rotates the propeller 32 and generates a force for lifting the balloon 12 from the ground 42. After a predetermined period of operation, the timer 28 deactivates the motor 24 and the balloon 12 falls toward the ground 42 under the effect of gravity. When the balloon 12 contacts the ground, light is concealed from the switch 38 and the motor 24 is activated. The balloon 12 then lifts from the ground 42 and rises until the motor 24 is again deactivated by the timer 28. The cycle of lifting and falling to the ground 42 resembles a hopping action of the balloon 12. By rotating the propeller about an axis that is at an angle to vertical, the object advances in a horizontal direction as it rises and falls. The manufacturer might, with this construction, make the balloon in the shape of a rabbit to simulate a live animal.

Figure 8:
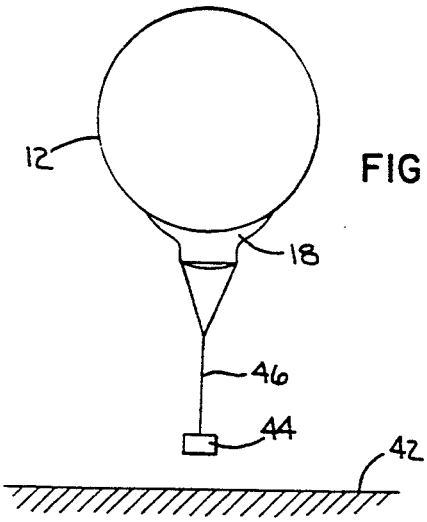
FIG. 8 is a side elevation view of an embodiment wherein the second alternative means has a force sensitive switch suspended from the movable object.
Figure 9:
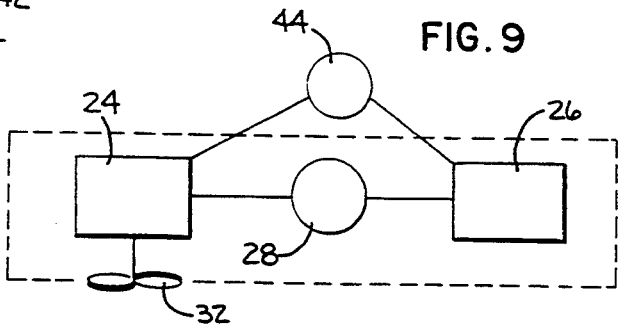
FIG. 9 is a schematic illustration of the embodiment shown in FIG. 8.

FIGS. 8 and 9 illustrate an embodiment wherein a force sensitive switch 44 is suspended from the balloon 12 by a cord 46. When the balloon 12 falls toward the ground 42 under the effect of gravity, the switch 44 first engages the ground 42 and activates the motor 24. The motor 24 rotates the propeller 32 and causes the balloon 12 to rise until the motor 24 is deactivated by the timer 28. Similar to the embodiment shown in FIGS. 6 and 7, the balloon 12 rises from and falls toward the ground 42.

Figure 12:
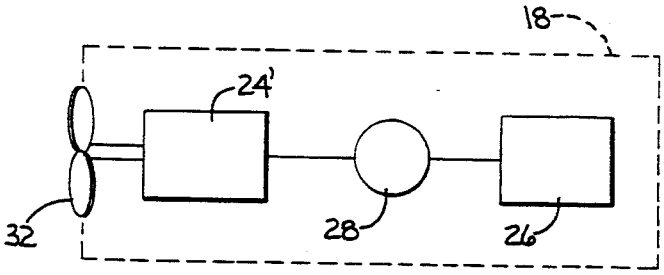
FIG. 12 is a schematic illustration of an embodiment having a reversible motor.
Figure 17:
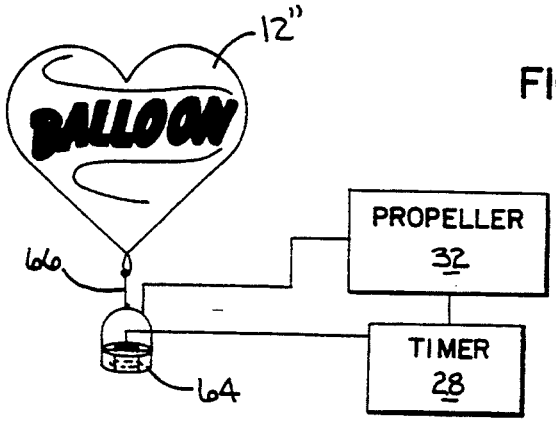
FIG. 17 is a side elevation view of an embodiment wherein the vessel has a gondola for carrying the propelling means.

FIGS. 10 and 11 illustrate an embodiment wherein a motion sensitive switch 48 is interconnected between the battery 26 and a reversible electric motor 24'. The switch 48 is suspended from the balloon 12 and is operable to reverse the direction of rotation of the propeller 32 when motion of the balloon 12 is obstructed. When the propeller 32 propels the balloon 12 into contact with any of the ceiling 40, the ground 42, or a sidewall 50 in a room in which the balloon 12 is operated, the motion sensitive switch 48 causes the motor 24 automatically to reverse and propel the balloon 12 away from the obstruction. Thus, as indicated in FIG. 11, the motor 24' is adapted to propel the balloon 12 in opposite substantially horizontal directions. Alternatively, and as schematically illustrated in FIG. 12, the reversible motor 24' is used on combination with the timer 28. The timer 28 controls the motor 24' to propel the balloon 12 along a first travel path for a predetermined time period. After the predetermined period of time, the timer 28 operates the motor 24' in a reverse direction and propels the balloon 12 along a second travel path. The invention further comprehends that both the timer 28 and the motion sensitive switch 48 could be used in combination with the reversible motor 24'.

When it is desired to prevent the balloon 12 from escaping, such as when the balloon 12 is operated outdoors, an eyelet 52 (see FIG. 13) is attached to the balloon 12 and is tethered on a fixed line 54. Alternate operation of the reversible motor 24' moves the balloon 12 along the line 54.

FIG. 14 illustrates an embodiment wherein an attitude sensitive switch 56 is interconnected between the battery 26 and the reversible electric motor 24'. The switch 56 is suspended from the balloon 12 and is operable to reverse the direction of rotation of the propeller 32 when the balloon 12 tilts. When the switch 56 detects a change in the angular attitude of the balloon 12, the switch 56 operates the motor 24' in a direction effective to vertically align the balloon 12. Once vertically aligned, the switch 56 deactivates the motor 24'.

The invention also comprehends that the object 10 is selectively movable in response to the impingement of light or heat projected from a remotely operated source, such as a flashlight 37. For instance, the embodiment of the invention illustrated in FIG. 15 has three motors 24 each having a corresponding photocell 38 connected to a common battery 26. Each of the motors 24 operates a separate propeller 32 for generating a force and propelling the balloon 12 in a different direction. When one of the photocells 38 receives light from a remote source 37 (e.g., a flashlight or light gun), the corresponding motor 24 activates and propels the balloon 12 in a first direction. When light is removed from one of the photocells 38, the corresponding motor 24 deactivates and ceases rotating its associated propeller 32. When another one of the photocells 38 receives light from the remote source, the corresponding motor 24 activates and propels the balloon 12 in a second direction.

Of course, the concept of actuating a motor 24 with a light source 37 as illustrated in FIG. 15 can be practiced with a object 10 having a single motor 24 and an associated photocell 38. Similarly, a movable object having four or more motors 24 each having a corresponding photocell 38 is comprehended by the present invention. Further, it is contemplated that the photocells (light sensors 38) can be replaced with sound sensors whereby impingement on the balloon 10 of an audio signal from a sound source 37', such as a whistle, a tuning fork, or a loud speaker, can be used to actuate one or more of the motors 24.

As a more simple alternative to the embodiment shown in FIG. 15, the invention envisions that a balloon is remotely levitated by shining light on the balloon and thereby heating air contained within the balloon. Warmed air inside the fluid tends to rise in the surrounding relatively dense atmosphere and thereby causes the balloon to lift.

More specifically, and as shown in FIG. 16, a balloon 12' has a light absorbing exterior surface 58 impinged upon by light 60 remotely projected from a manually operated light gun 62. The exterior surface 58 of the balloon 12' preferably has a flat black finish whereby the absorption of light 60 and the resulting heating of air contained in the balloon 12' is maximized. When light is removed from the balloon 12', the air within the balloon cools and the balloon begins to descend slowly. Reapplication of light onto the surface 58 causes the air inside the balloon 12' to reheat and the balloon again rises.

In an alternative embodiment of the invention, the propeller 32 is powered by a rubber band and the electric motor 24 and the battery 26 are omitted.

FIGS. 17–21 show modified embodiments of a movable object in which a gondola (or basket) 64 is suspended from a balloon 12" by a line 66. Similar to the embodiments discussed above, the gondola 64 carries a motorized propeller and a source of energy for operating the propeller. Depending on the orientation of the gondola 64, the propeller generates a thrust force for propelling the balloon in a particular direction. For example, with the gondola 64 supported in the vertical orientation shown in FIG. 17, the propeller generates a thrust force which lifts the balloon 12".

Figure 18:
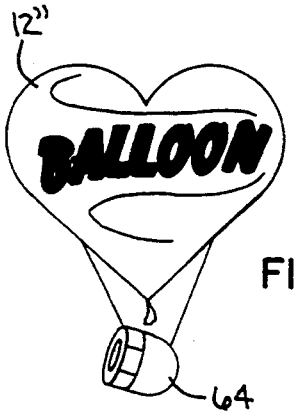
FIG. 18 is a side elevation view of an embodiment wherein a gondola is supported at an angle for generating a thrust force which has both vertical and horizontal components.
Figure 19:
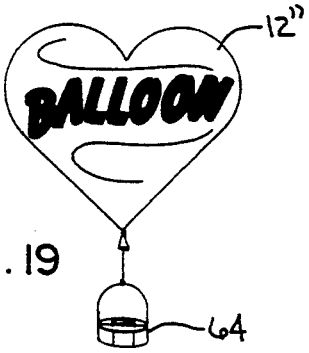
FIG. 19 is a side elevation view of an embodiment wherein a gondola is inverted and the propelling means therein generates a downward thrust force.

The propeller generates a thrust force having a lateral component when the gondola 64 is inclined at an angle, as shown in FIG. 18. Lateral thrust force causes the balloon to move in both vertical and horizontal directions when the propeller operates. Alternatively, and as shown in FIG. 19, when the gondola 64 is inverted, the propeller generates a downward thrust force which causes the balloon 12" to descend. When the propeller stops rotating, gas in the balloon 12" causes the balloon to rise.

Figure 20:
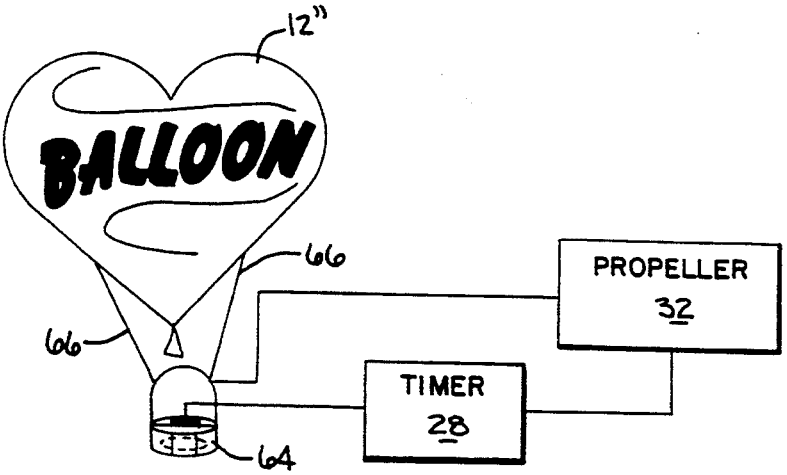
FIG. 20 is a side elevation view of an embodiment wherein a gondola is suspended from a vessel by two lines to prevent the gondola from rotating relative to the vessel.
Figure 21:
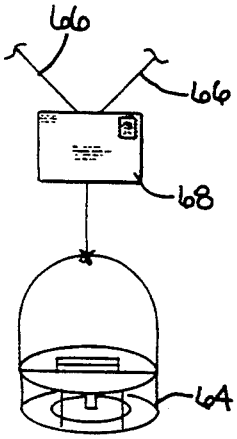
FIG. 21 is a side elevation view of an embodiment having ballast receiving means.

The manner in which the gondola 64 is suspended from the balloon 12" results in different responses of the gondola 64 when the propeller generates thrust. For example, the gondola 64 is caused to rotate when the propeller operates. The amount of rotation of the gondola 64" is increased when the length of the line 66 is increased. In addition, rotation of the gondola 64 is effectively prevented by suspending the gondola 64 from the balloon 12" with two lines 66, as shown in FIG. 20.

Buoyancy characteristics of the balloon 12" can be modified by attaching a ballast carrying device, such as an envelope 68 (FIG. 21) to the lines 66. Ballast can be placed in the envelope to achieve a stationary equilibrium position wherein the mass of the ballast and the balloon 12" and the gondola 64 are equivalent to the lift force generated by gas in the balloon 12". Exemplary ballast includes paper clips, coins, and small pieces of paper.

Figure 22:
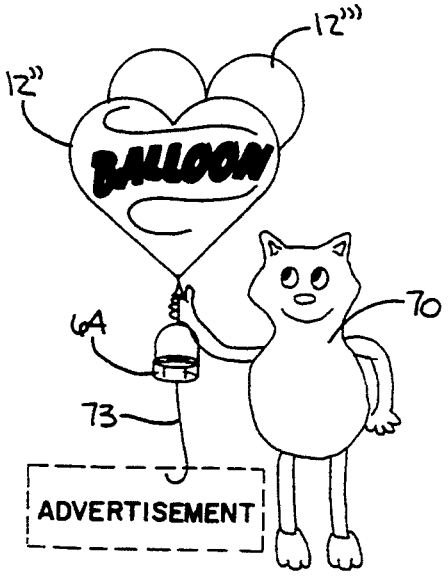
FIG. 22 is a side elevation view of an embodiment wherein the movable object illustrated in FIG. 17 is used to lift a character.

FIG. 22 shows an application of a balloon 12" for lifting an animated character 70. Lighter-than-air gas in the balloon 12" provides a lift force which assists the motorized propeller in the gondola 64 lift the character 70. An optional second balloon 12"' is shown attached to the gondola 64 in the same manner as the balloon 12". Two or more balloons can be used on all the embodiments described herein. For example, a plurality of balloons could be attached, as to simulate a bouquet.

FIG. 22 also shows an advertisement suspended from the gondola 64 by a hook or line 73, which makes the invention structure even more versatile.

Figure 23:
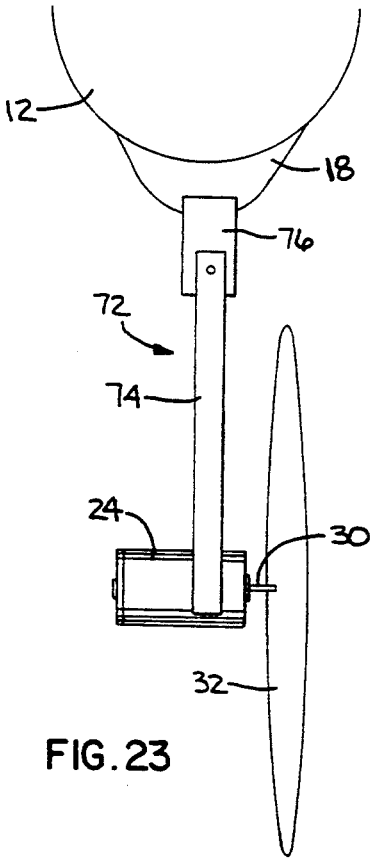
FIG. 23 is a side elevation view of an embodiment wherein a motor and propeller are pivoted to a vessel.
Figure 24:
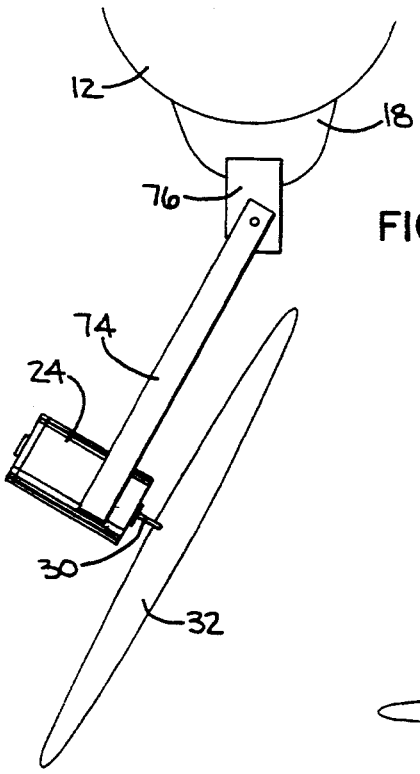
FIG. 24 is a side elevation view of the movable object illustrated in FIG. 23 wherein the object is propelled in a vertical direction and a horizontal direction.
Figure 25:
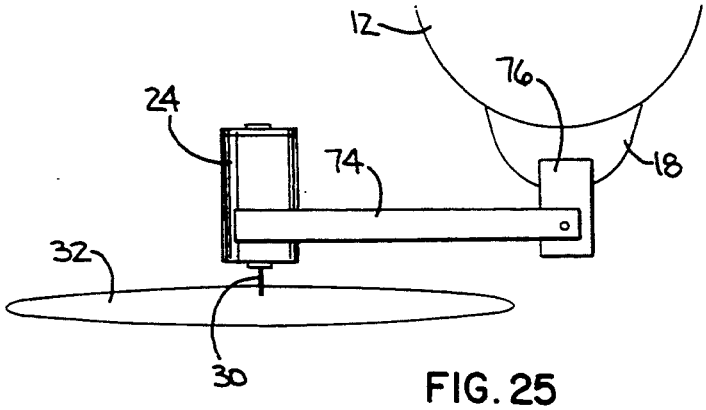
FIG. 25 is a side elevation view of the movable object illustrated in FIG. 23 wherein the object is propelled in only a vertical direction.

FIGS. 23–25 illustrate a suspension 72 for attaching a motor 24 and a propeller 32 mounted on the output shaft 30 of the motor 24 to a balloon 12. The suspension 72 has an arm 74 pivoted to a mount 76. The mount 76 is fixed to the shell 18 on a balloon 12 (FIG. 1) or is attached to a gondola 64 (FIGS. 17–21) suspended from a balloon 12. When the arm 74 is substantially vertical, as shown in FIG. 23, the motor 24 can be operated intermittently to generate short bursts of thrust to move the balloon 12 in a desired direction. Increased thrust (i.e. increased motor speed) causes the arm 74 to rotate (FIG. 24) relative to the mount 76 whereby a thrust force generated by the propeller 32 has a vertical component and thus causes the balloon 12 to lift or to descend, depending on the direction of rotation of the propeller 32. Full thrust (i.e. maximum motor speed) causes the arm 74 to rotate to a substantially horizontal position (FIG. 25) whereby a thrust force generated by the propeller 32 has no horizontal component and thus causes the balloon 12 to move only in a vertical direction.

Figure 26:
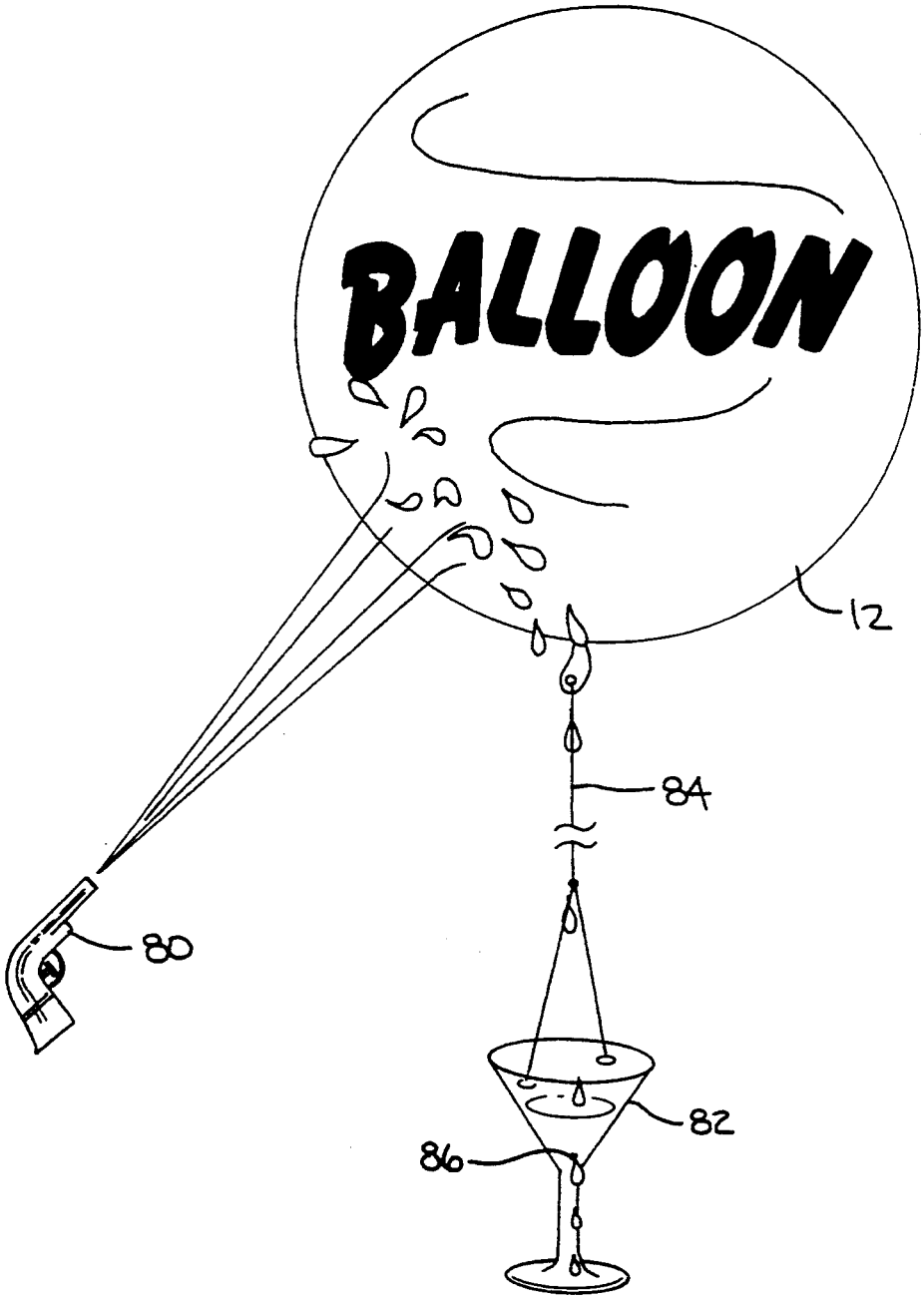
FIG. 26 is a side elevation view of an embodiment wherein a vessel includes means responsive to the impingement of liquid thereon for selectively moving the vessel through the atmosphere.

The invention also comprehends that the object 10 is selectively movable in response to the impingement of liquid propelled from a remotely operated source, such as a squirt gun 80 in FIG. 26. The embodiment shown in FIG. 26 can be used as target shooting amusement, for example, wherein the object is to cause a lighter-than-air balloon to land on the ground.

More particularly, a liquid receptacle 82 is suspended from a balloon 12 by a line 84. Lighter-than-air gas in the balloon 12, such as helium, causes the balloon 12 to rise when the receptacle 82 is empty. An individual can propel liquid at the surface of the balloon 12 such that liquid strikes the balloon and collects in the receptacle 82. The balloon 12 descends when the weight of liquid in the receptacle 82 exceeds the lift force of gas in the balloon 12. Liquid spills from the receptacle 82 when the receptacle strikes the ground and the balloon 12 again lifts. In a modified embodiment, the receptacle 82 can have an opening 86 through which liquid continuously discharges from the receptacle 82. An individual must fill the receptacle 82 faster than the rate at which liquid escapes through the opening 86 in order to cause the balloon 12 to descend.

The foregoing embodiments demonstrate the many unique and amusing effects which the present invention is capable of providing. However, the present invention and all related embodiments are to be considered in all respects as illustrative and not restrictive, and the invention is not to be limited to the details given herein. Thus, it will be understood that the invention may be embodied in other specific forms without departing from the spirit or central characteristics thereof.

We claim:

1. An object that is selectively movable at low speeds through a body of air, said object comprising:
   - a vessel having means for containing a predetermined quantity of a lighter than air fluid;
   - first means on the vessel for causing the vessel to move in a suspended state within a body of air in which the vessel is immersed,
   - said first means having at least first and second states,
   - said first means in said first state causing said vessel to be propelled along a travel path,
   - said first means in said second state causing said vessel to one of a) move principally under the force of gravity along a travel path and b) remain substantially in a static state suspended within a body of air within which said vessel is immersed; and
   - second means on the vessel including a timer for automatically changing the first means from one of its first and second states to the other of its first and second states and back to said one of its first and second states without intervention by an operator.

2. The object of claim 1 wherein said first fluid is helium.

3. The object of claim 1 wherein said first means includes an energy source carried by the vessel.

4. The object of claim 3 wherein said energy source is a battery.

5. The object of claim 3 wherein said energy source is a solar energy cell.

6. The object of claim 1 wherein said first means comprises a propeller and means for rotating said propeller and generating a force for moving the object.

7. The object of claim 6 wherein said means for rotating the propeller is an electric motor.

8. The object of claim 6 in which said propeller has a first position in which the propeller generates a force for moving the object in a first direction and a second position in which the propeller generates a force for moving the object in a second direction.

9. An object that is selectively movable through a fluid in which the object is at least partially immersed, said object comprising:
   - a vessel having means for containing a predetermined a quantity of a first fluid:
   - first means on the vessel for causing the vessel to move within a fluid within which the vessel is at least partially immersed,
   - said first means having first and second states,
   - said first means in said first state causing said vessel to move along a first travel path,
   - said first means in said second state causing said vessel to one of a) move along a second travel path within a fluid within which said vessel is at least partially immersed which is different from said first travel path and b) remain substantially in a static state within a fluid within which said vessel is at least partially immersed; and second means on the vessel for automatically changing the first means from one of its first and second states to the other of its first and second states without intervention by an operator, wherein said first means comprises a propeller and means for rotating said propeller and generating a force for moving the object, wherein said propeller has a first position in which the propeller generates a force for moving the object in a first direction and a second position in which the propeller generates a force for moving the object in a second direction, there being a link that is pivotably connected between the vessel and the propeller and permits the propeller to automatically move between said first position and said second position in response to the magnitude of said thrust force.

10. The object of claim 1 wherein said first means includes means for prescribing the direction of a travel path along which the object moves.

11. An object that is selectively movable through a fluid in which the object is at least partially immersed, said object comprising:

a vessel having means for containing a predetermined quantity of a first fluid;

first means on the vessel for causing the vessel to move within a fluid within which the vessel is at least partially immersed, said first means having first and second states, said first means in said first state causing said vessel to move along a first travel path, said first means in said second state causing said vessel to one of a) move along a second travel path within a fluid within which said vessel is at least partially immersed which is different from said first travel path and b) remain substantially in a static state within a fluid within which said vessel is at least partially immersed; and second means on the vessel for automatically changing the first means from one of its first and second states to the other of its first and second states without intervention by an operator, wherein said first means comprises a powered propeller for generating a force and the vessel has a variable opening through which the propeller directs air to move the object.

12. The object of claim 1 wherein said second means comprises a programmable timer.

13. The object of claim 1 wherein said first means comprises means for causing said vessel to move in a substantially vertical direction.

14. The object of claim 1 wherein said first means comprises means for causing said vessel to move in a substantially horizontal direction.

15. The object of claim 1 including means for constraining movement of said vessel when said first means is in at least one of said first state and said second state.

16. The object of claim 1 wherein said first means has a third state and the first means comprises means for moving said vessel in a direction which is substantially opposite to a direction in which said vessel is caused to move by said first means in said first state with the first means in the third state.

17. The object of claim 1 wherein at least one of said first means and said second means is suspended from the vessel by a line.

18. The object of claim 17 including a basket for receiving said at least one means.

19. The object of claim 17 wherein said at least one of said first means and said second means is suspended from the vessel by two lines to prevent said at least one means from rotating relative to said vessel.

20. The object of claim 1 including means associated with said vessel for removably receiving ballast therein and modifying buoyancy characteristics of said object.

21. The object of claim 1 wherein there is no line connected to the object so that the object can move freely through a body of air.

* * * * *